US005836475A

United States Patent [19]

Boldrini

[11] Patent Number: 5,836,475

[45] Date of Patent: Nov. 17, 1998

[54] DEVICE FOR THE ORDERLY SUPPLY OF ELONGATED ARTICLES, IN PARTICULAR TOBACCO PRODUCTS

[75] Inventor: Fulvio Boldrini, Ferrara, Italy

[73] Assignee: G.D Socitea' Per Azioni, Bologna, Italy

[21] Appl. No.: 797,469

[22] Filed: Feb. 6, 1997

[30] Foreign Application Priority Data

Feb. 7, 1996 [IT] Italy ..... BO96A0054

[51] Int. Cl.[6] ..... B65G 59/00

[52] U.S. Cl. ..... 221/131; 221/277; 131/282; 131/283; 53/444; 53/149

[58] Field of Search ..... 131/282, 283; 53/444, 149, 151, 236, 148; 221/131, 277

[56] References Cited

U.S. PATENT DOCUMENTS 4,096,682 6/1978 Sheahan ..... 53/149

5,548,941 8/1996 Portaro et al. ..... 53/444

FOREIGN PATENT DOCUMENTS 0 277 363 A 12/1987 European Pat. Off. ..... 131/270

1 524 463 3/1976 United Kingdom ..... 131/270

*Primary Examiner*—Vincent Millin

*Assistant Examiner*—Charles W. Anderson

*Attorney, Agent, or Firm*—Marshall, O'Toole, Gerstein, Murray & Borun

[57] ABSTRACT

A device for the orderly supply of cigarettes; the device presenting at least one channel defined by two lateral walls and for feeding a respective column of cigarettes at a given dropdown speed and in a given traveling direction to the bottom opening of the channel; and an ordering device being provided upstream from the bottom opening in the traveling direction, and presenting at least two engaging elements located at either end of one of the two lateral walls and movable inside the channel to accompany the cigarettes along a given portion of the channel and so feed the cigarettes in orderly manner to the bottom end.

16 Claims, 2 Drawing Sheets

DEVICE FOR THE ORDERLY SUPPLY OF ELONGATED ARTICLES, IN PARTICULAR TOBACCO PRODUCTS

BACKGROUND OF THE INVENTION

The present invention relates to a device for the orderly supply of elongated articles, in particular tobacco products.

Cigarette manufacturing systems are known to feature feedboxes with output channels defined by respective pairs of substantially parallel partitions, and along which the cigarettes are fed by gravity crosswise to their longitudinal axis and in a given traveling direction.

The downflow of cigarettes inside each channel is normally regulated by shutter devices associated with the channel and comprising respective shutter elements housed inside respective seats formed in one of the two partitions, and which rotate intermittently and selectively, about respective axes crosswise to the traveling direction, between an idle position in which the shutter elements are located outwards of the respective channel to permit the passage of the cigarettes, and an engaged position in which the shutter elements are located inside the respective channel to arrest the downflow of cigarettes inside the channel.

While providing for substantially accurately regulating the downflow of cigarettes inside the channels, known shutter devices of the above type present several drawbacks, due, firstly, to their failing to regulate the downflow speed of the cigarettes inside the channels, and, secondly, to their possibly damaging the cigarettes superficially by crushing them against the adjacent partition as they rotate between the idle and engaged positions.

SUMMARY OF THE INVENTION

It is an object of the present invention to provide a straightforward, low-cost device for the orderly supply of elongated articles, particularly tobacco products, designed to overcome the aforementioned drawbacks.

According to the present invention, there is provided a device for the orderly supply of elongated articles, in particular tobacco products; the device comprising at least one channel presenting a bottom opening and a longitudinal axis; and the channel being defined by two lateral walls parallel to said axis and separated by a distance substantially equal to a thickness of the articles, so as to permit a respective column of articles to travel, with their respective axes crosswise to said axis, along the channel to said bottom opening; characterized by comprising an ordering device located outside said channel and upstream from said bottom opening along said axis, and which in turn comprises at least two engaging elements movable successively along respective given portions of respective end edges of at least one of said two lateral walls, and cooperating with respective ends of said articles to accompany the articles along a substantially central portion of said given portion, and to feed the articles in orderly manner to said bottom opening.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 2:
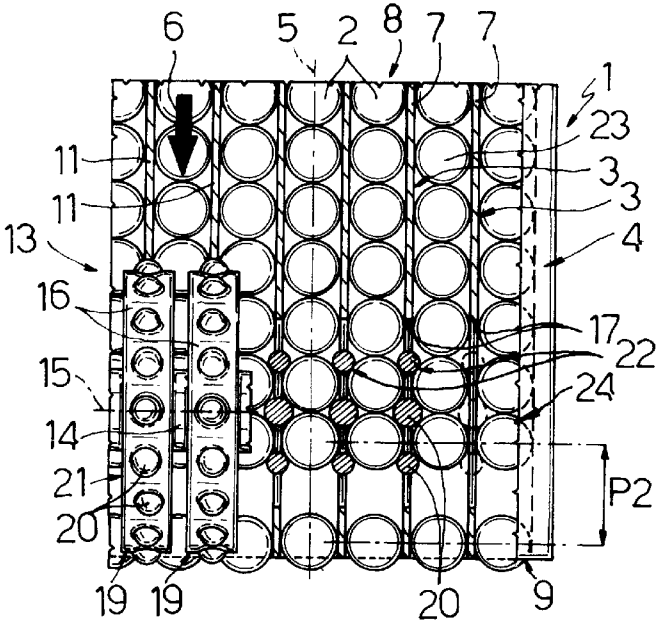
FIG. 2 shows an end view, with parts in section and parts removed for clarity, of the FIG. 1 device.
Figure 1:
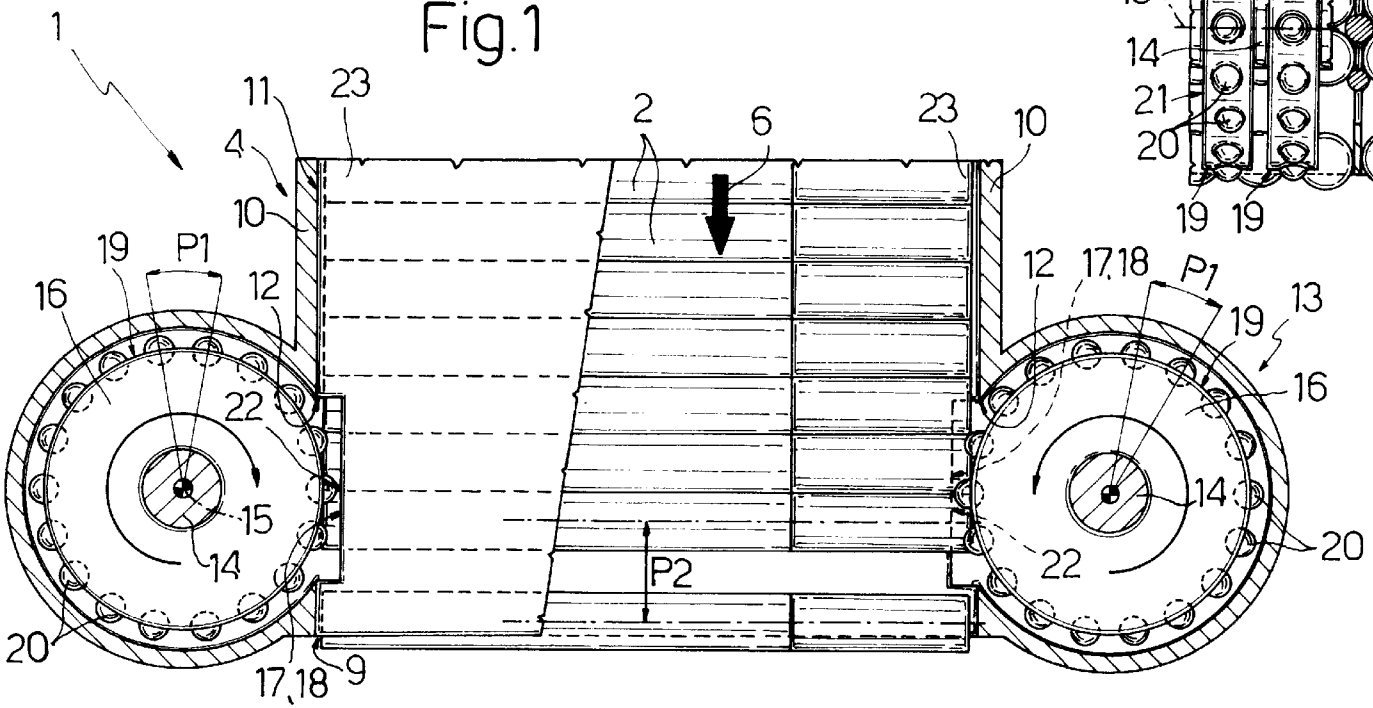
FIG. 1 shows a side section of a first preferred embodiment of the device according to the present invention.

Number 1 in FIGS. 1 and 2 indicates a device for the orderly supply of cigarettes 2 along the output channels 3 of a feedbox 4.

Each channel 3 presents a vertical longitudinal axis 5 parallel to the traveling direction 6 of cigarettes 2, and is defined by two lateral walls 7 parallel to axis 5 and separated from each other by a distance substantially equal to the diameter of cigarettes 2, so as to permit a respective column 8 of cigarettes 2 to drop by force of gravity along, and towards a bottom output opening 9 of, channel 3. Channels 3 are also defined by two end walls 10 crosswise to, and connected to the longitudinal end edges 11 of, walls 7; and each wall 10 presents an opening 12 located upstream from bottom opening 9 in direction 6, and extending crosswise to axis 5 in front of all of channels 3.

Device 1 also comprises an ordering device 13 facing openings 12 and in turn comprising two drive shafts 14, which are coaxial with respective axes of rotation 15 crosswise to axis 5, are located in front of respective openings 12 at opposite ends of walls 7, and rotate in opposite directions. Device 13 also comprises, for each wall 7, two wheels 16 fitted, at either end of respective wall 7, to respective shafts 14 and located through openings 12 and in front of respective longitudinal cavities 17 formed along respective edges 11 at openings 12 and presenting respective end surfaces 18 separated by a distance substantially smaller than the length of cigarettes 2. Said two wheels 16 are defined externally by respective cylindrical peripheral surfaces 19 coaxial with respective axes 15 and substantially tangent to respective vertical planes defined by edges 11.

Device 1 also comprises a number of engaging elements 20 equally spaced along surface 19 of each wheel 16 with a given spacing P1 substantially equal to the thickness of cigarettes 2. More specifically, the elements 20 on each wheel 16 are aligned along respective axis 15 with the elements 20 on the other wheels 16, so as to form a given number of rows 21 parallel to respective axes 15.

Elements 20 are preferably, but not necessarily, substantially spherical, and extend radially outwards of surfaces 19 so as to be substantially tangent, as wheels 16 rotate, with at least a central portion 22 of surfaces 18, and so as to cooperate with respective ends 23 of cigarettes 2 to accompany them at least along portion 22 and feed cigarettes 2 in orderly manner to respective bottom opening 9.

Operation of device will be described with reference to FIGS. 1 and 2, which show the channels 3 of a central portion of a feedbox 4, in which the columns 8 of cigarettes 2 travel towards bottom openings 9 of channels 3 at a fall speed V1 parallel to direction 6, and so as to form a succession of superimposed layers 24 of cigarettes 2.

As cigarettes 2 reach openings 12, respective ends 23 projecting outwards of cavities 17 are gradually engaged by elements 20, which, rotating with respective wheels 16 about respective axes 15, are inserted inside the gaps defined by two cigarettes 2 in one layer 24 and by two cigarettes 2 in the adjacent upper layer 24 to accompany cigarettes 2 along at least portions 22.

Wheels 16 preferably rotate continuously about respective axes 15, so that elements 20 travel along respective portions 22 at a given speed V2 at least approximately equal to but no greater than speed V1, and the downward travel of cigarettes 2 inside channels 3 is therefore controlled by elements 20, which, acting simultaneously on the cigarettes 2 in each layer 24, provide for separating one layer 24 from the adjacent upper layer 24, and so feeding layers 24 to bottom openings 9 with a given spacing P2 approximately equal to but no smaller than spacing P1 of elements 20.

Figure 4:
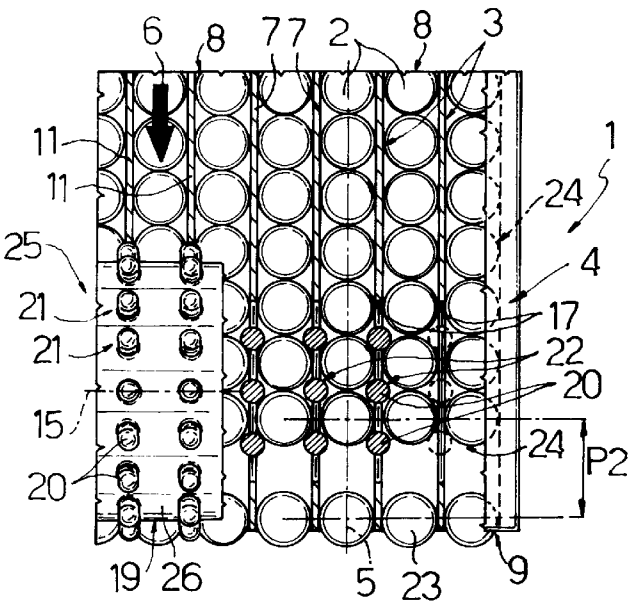
FIG. 4 shows an end view, with parts in section and parts removed for clarity, of the FIG. 3 device.
Figure 3:
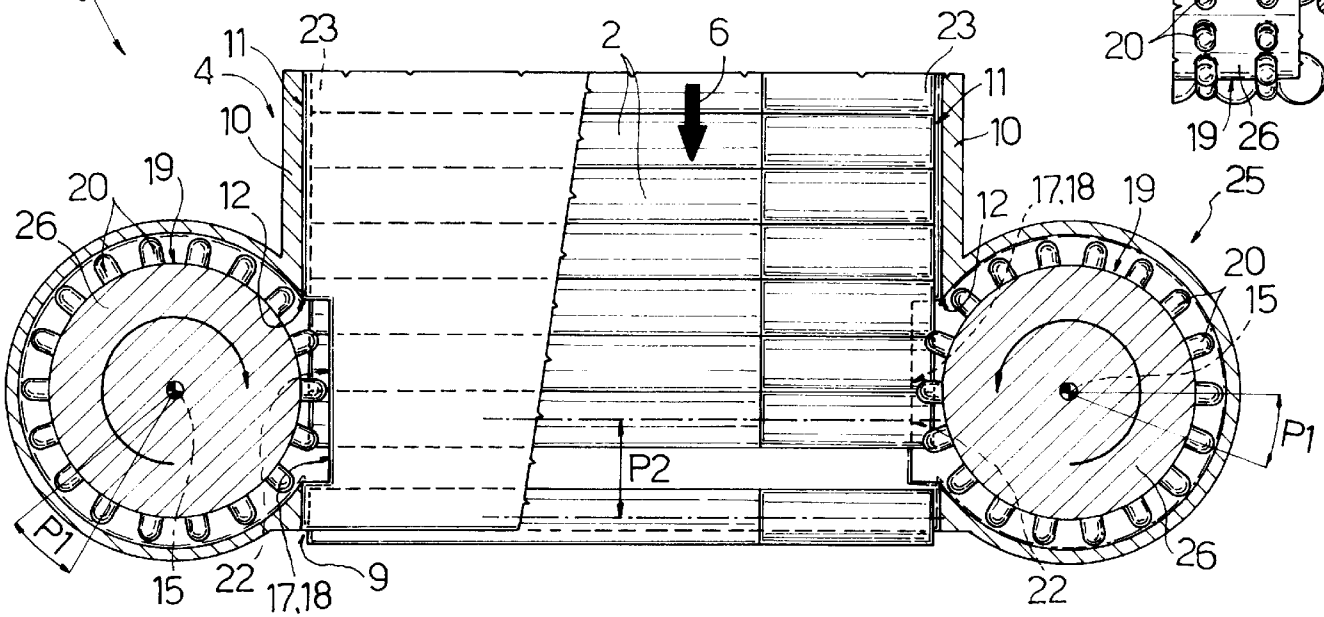
FIG. 3 shows a side section of a second preferred embodiment of the FIG. 1 device.

FIGS. 3 and 4 show an ordering device 25 similar to device 13, except that the wheels 16 fitted side by side to the same shaft 14 are replaced by a substantially cylindrical roller 26 fitted to shaft 14 and defined externally by peripheral surface 19, and elements 20 are of substantially cylindrical, elongated shape and are positioned substantially tangent to respective portions 22.

Device 25 operates in the same way as device 13, and therefore requires no further explanation.

In addition to feeding cigarettes 2 in orderly manner along channels 3 to bottom openings 9, device 1 therefore also provides for feeding each layer 24 separately to bottom openings 9, so that the cigarettes 2 in respective channels 3 drop down in the same manner, and the bottom layer 24 is separated from the layers 24 still inside channels 3 with no need for the separating devices normally provided at bottom openings 9.

In the light of the foregoing description, wheels 16 and rollers 26 may obviously be replaced by other technically equivalent elements comprising, for example, belts (not shown) fitted with engaging elements 20 and looped about respective powered rollers.

I claim:

1. A device for the orderly supply of elongated articles, the device comprising at least one channel presenting a bottom opening and a longitudinal axis; and the channel being defined by two lateral walls parallel to said longitudinal axis and separated by a distance substantially equal to a thickness of the articles, so as to permit a respective column of articles to travel, with their respective axes crosswise to said axis, along the channel to said bottom opening; characterized by comprising an ordering device located outside said channel and upstream from said bottom opening along said axis, and which in turn comprises at least two engaging elements movable successively along respective given portions of respective end edges of at least one of said two lateral walls, and cooperating with respective ends of said articles to accompany the articles along a substantially central portion of said given portion, and to feed the articles in orderly manner to said bottom opening.

2. A device as claimed in claim 1, characterized by comprising actuating means associated with said engaging means and for moving the engaging means along the respective said given portions and at a given speed at least approximately equal to but no greater than a dropdown speed of said articles.

3. A device as claimed in claim 2, characterized in that said actuating means are continuous actuating means for moving said engaging elements continuously and at said given speed along at least the respective said central portions, while maintaining the engaging elements tangent to the central portions.

4. A device as claimed in claim 3, characterized in that the actuating means comprise at least two wheels mounted for rotation about respective axes of rotation located crosswise to said longitudinal axis and at either end of said lateral wall each wheel being defined externally by a respective peripheral surface supporting the respective engaging element.

5. A device as claimed in claim 4, characterized in that each said peripheral surface is a cylindrical surface coaxial with the respective said axis of rotation, and is positioned facing the respective said given portion; the engaging elements extending radially outwards from the respective peripheral surfaces.

6. A device as claimed in claim 5, characterized by comprising a number of engaging elements equally spaced on each of said peripheral surfaces.

7. A device as claimed in claim 6, characterized in that said engaging elements are arranged on the respective peripheral surfaces with a given spacing substantially equal to the thickness of said articles.

8. A device as claimed in claim 7, characterized in that said engaging elements are moved by the respective wheels at said given speed along the respective given portions so as to feed the articles in the respective column to said bottom opening with a given supply spacing; the supply spacing being approximately equal to but no smaller than said given spacing.

9. A device as claimed in claim 3, characterized in that said actuating means comprise, for each said lateral wall, two wheels located at either end of the lateral wall; the wheels presenting respective peripheral surfaces, and being mounted for rotation about respective axes of rotation located crosswise to said longitudinal axis and at either end of said lateral wall.

10. A device as claimed in claim 9, characterized by comprising a number of engaging elements; the engaging elements being equally spaced on each peripheral surface of each wheel with a given spacing.

11. A device as claimed in claim 10, characterized by comprising at least two side by side channels for feeding respective columns of cigarettes in a succession of layers of cigarettes; the engaging elements of each wheel being aligned along the respective axis of rotation with the engaging elements of the other wheels to form a given number of rows of engaging elements.

12. A device as claimed in claim 11, characterized in that said actuating means move each row along the respective central portion so that the respective engaging elements engage the cigarettes in each layer to feed the layer individually to the bottom openings of the channels.

13. A device as claimed in claim 3, characterized by comprising two substantially cylindrical rollers located outside said channel; the rollers being mounted for rotation about respective axes of rotation located crosswise to said longitudinal axis and at either end of said lateral wall, and being defined externally by respective peripheral surfaces coaxial with the respective axes of rotation.

14. A device as claimed in claim 1, characterized in that said central portions present respective end surfaces separated, at least at said ordering device, by a distance substantially smaller than a length of said articles.

15. A device as claimed in claim 1, characterized in that said engaging elements are substantially spherical.

16. A device as claimed in claim 1, characterized in that said engaging elements are substantially cylindrical and elongated.

* * * * *

UNITED STATES PATENT AND TRADEMARK OFFICE

CERTIFICATE OF CORRECTION

PATENT NO. : 5,836,475

DATED : November 17, 1998

INVENTOR(S) : Fulvio Boldrini

It is certified that error appears in the above-identified patent and that said Letters Patent is hereby corrected as shown below:

TITLE PAGE:

[73] change "G.D. Socitea' Per Azioni, Bologna, Italy" to --G.D Societa' Per Azioni, Bologna, Italy--

Signed and Sealed this

Sixteenth Day of March, 1999

*Attest:*

*Attesting Officer*

Q. TODD DICKINSON

*Acting Commissioner of Patents and Trademarks*